United States Patent [19]

Suganuma

[11] Patent Number: 4,900,025

[45] Date of Patent: Feb. 13, 1990

[54] MATCHED SET OF GOLF CLUBS AND METHOD OF PRODUCING THE SAME

[76] Inventor: Noriyuki Suganuma, 2-9-17, Nigata-Minami, Minami-Ku, Yokohama-Shi, Kanagawa-Ken, Japan

[21] Appl. No.: 86,550

[22] Filed: Aug. 18, 1987

[30] Foreign Application Priority Data

Aug. 27, 1986 [JP] Japan ..... 61-198947

[51] Int. Cl.[4] ..... A63B 53/00

[52] U.S. Cl. ..... 273/77 A; 273/77 R

[58] Field of Search ..... 273/77 A, 77 R

[56] References Cited

U.S. PATENT DOCUMENTS

| | | | |
|---|---|---|---|
| 4,070,022 | 1/1978 | Braly | 273/77 A |
| 4,128,242 | 12/1978 | Elkins | 273/77 A |
| 4,415,156 | 11/1983 | Jorgensen | 273/77 A |

FOREIGN PATENT DOCUMENTS

| | | | |
|---|---|---|---|
| 412400 | 6/1934 | United Kingdom | 273/77 A |
| 1286255 | 8/1972 | United Kingdom | 273/77 A |

OTHER PUBLICATIONS

Article, "Dynamic New Ways to Match Clubs so They Feel the Same", Larry Dennis, Golf Digest Dec. 1976, pp. 560–64.

*Primary Examiner*—Martin P. Schwadron
*Assistant Examiner*—Allen J. Flanigan
*Attorney, Agent, or Firm*—Edmund M. Jaskiewicz

[57] ABSTRACT

A dynamically correlated, matched set of golf clubs which comprises a plurality of golf clubs each of which has a shaft having one end with a grip and the other end with a head, wherein each grip has a substantially uniform weight, moments of force at the head end sides of said golf clubs are standardized with reference to a substantially central portion between both hands of a golf player who holds the golf club during swing about a rotating axis, and when natural frequencies at the club head end side of said golf clubs in said set are measured with reference to said central portion as a support end so that natural frequencies of arbitrary clubs A and B are given as Fa and Fb and lengths from the support end to the centers of gravity extending from the support ends to head ends of said clubs are given as La and Lb, each shaft has a stiffness characteristic satisfying a substantial relation Fa·La=Fb·Lb.

4 Claims, 1 Drawing Sheet

$$Fa \cdot La = Fb \cdot Lb$$

$$Fa \cdot La = Fb \cdot Lb$$

MATCHED SET OF GOLF CLUBS AND METHOD OF PRODUCING THE SAME

BACKGROUND OF THE INVENTION

1. Field of the Invention

The present invention relates to a matched set of golf clubs and a method of producing the same, wherein a portion on the grip central to both hands of a golf player who holds a golf club during swing (spaced from a grip end by 10.5 cm, a distance which may vary depending on personal differences) is determined as the standardized rotating axis of the moment of force of each club constituting the set, and is also employed as the reference point for measuring the natural frequencies of the respective golf clubs, whereby the golf clubs are dynamically correlated based on the new standard.

2. Prior Art

Standarizing the balance of golf clubs in a conventional set of golf clubs is known. A method for maintaining constant the moment of force around a rotating axis has been proposed in order to standardize the feel of a set of golf clubs when a player grips golf clubs having different weights, and is represented by swing weights. Recently, in some sets of golf clubs, the swing weight is changed for each club.

However, a rotating axis serving as the reference for measuring the moment of force is separated from an actual hinge or pivot at which a golf player grips and swings a golf club. For this reason, the dynamic correlation between the swing weight and the stiffness characteristic of a shaft is left unclear. Using the conventional method of matching golf clubs, it is difficult to obtain a sufficiently matched set of golf clubs.

Furthermore, in a method for measuring a natural frequency of each club correlated with the swing weight to match a set of golf clubs in consideration of the stiffness characteristic of a shaft (U.S. Pat. No. 4,070,022 "MATCHED GOLF SHAFTS AND CLUBS"), a position of a club support end serving as the reference for measuring an important natural frequency is dynamically unclear. In addition, correlation of deflective or flexure characteristics between a certain golf club and other clubs in a set is left unclear. Therefore, the golf clubs cannot be satisfactorily matched.

SUMMARY OF THE INVENTION

It is an object of the present invention to provide a dynamically correlated, sufficiently matched set of golf clubs and a method of producing the same, which is free from the conventional drawbacks, and can provide a uniform bending or deflection to each club during swing, resulting in good play.

The principle of the set of golf clubs according to the present invention is to determine the common reference for measuring moments of force and natural frequencies of clubs in a set. With this reference, dynamic correlation between the natural frequency of each golf clubs and deflection of a shaft during swing is obtained.

The position of the reference may slightly vary depending on personal differences of golf players. Therefore, the balance is standardized in consideration of the personal differences. In this invention, the description will be made while assuming that the same person uses the golf clubs as a set.

(A) The reason why the reference for measuring the moment of force and natural frequency of each club in a set corresponds to that portion on the grip central to both hands of a golf player holding a golf club grip is that a hinge between the golf player and a golf club is nothing but his both hands, the both hands sense a weight of the golf club due to the gravity, and the central portion of the both hands with respect to the grip is the center of the moment of force couple applied to the golf club.

The principle upon which the reference for standardizing the moment of force is based is apparent from the following test.

A 20-g lead member is inserted in a shaft near a grip of an arbitrarily selected golf club. If the lead member is located at a head end side from the central portion to both hands, a player feels that the weight during swing is increased. Contrary to this, if the lead member is located at the grip end side, the player feels that the weight of the head during swing is decreased (though the inertial moment is increased). Conventionally, this method has been used to adjust the swing weight.

A method for standardizing moments of force of golf clubs in a set is known. In the present invention, the position of the rotating axis as the measurement reference is only different from that in the conventional method. In this invention, the position of the rotating axis is determined as substantially the central portion to both hands (said central portion spaced from the grip end by about 10.5 cm although it varies slightly in accordance with the personal differences of golf players).

(B) When the moment of force couple is applied from both hands to each club in the set, the center of gravity of each club must match distances (displacements) due to deflection of shaft with each other in different golf clubs.

In this case, deflection of shaft from the reference (Or) to a grip end is very small, and can be ignored. In addition, since the moment of force from the reference to the grip end is the same for every club (respective grips have substantially the same weight), it needs not be considered.

It is disclosed or confirmed in the present invention that deflection of shaft during swing is matched by measuring a natural frequency, from the dynamic point of view in that the center of mass of an object moving along a plane is moved as if all the mass of the object were concentrated on the center and all the external forces act thereon.

The drawing schematically shows arbitrarily selected golf clubs A and B and various measurements thereon upon which the relationships of the present invention is based.

When the natural frequencies of arbitrary different golf clubs A and B in a set are measured using the reference (Or) as the support end, and each golf club is mono-vibrated while the longitudinal direction of the golf club is parallel to the horizontal direction, these natural frequencies being designated as Fa and Fb, displacements of static deflection of portions at the centers of gravity (Ga, Gb) extending from the support ends (Or) to the head ends are given as Ra and Rb. In this case, the natural frequencies Fa and Fb of the golf clubs A and B can be dynamically expressed as follows:

$$Fa = 1/2\pi \sqrt{g/Ra} \quad \text{(g: acceleration of gravity)}$$

-continued $$Fb = 1/2\pi \sqrt{g/Rb}$$

Therefore, the relation Fa Ra=Fb Rb can be established.

When the golf clubs A and B are swung, displacements at the centers of gravity (Ga, Gb) corresponding to Ra and Rb correspond to deflections of the shafts by two forces applied to the center of mass (center of gravity), i.e., the moment of force due to the same gravity for the golf clubs A and B and the moment of force couple applied by a golf player.

These displacements correspond to displacements (Δa, Δb) proportional to lengths La and Lb from the support ends (Or) of the golf clubs to the centers of mass (Ga, Gb) extending from the support ends to head ends since identical forces are applied to the centers of mass of these clubs if displacements of deflection with respect to a given distance from the reference (Or) to the head end is substantially uniform.

Therefore, The relation Fb·La=Fb·Lb can be established. If the golf clubs A and B have proper stiffness and similar deflection characteristics of their shafts to satifsy this relation, the displacements Δa and Δb of the centers of mass (Ga, Gb) when swing is performed at an identical angular velocity correspond to displacements during an identical time.

More specifically, the golf clubs A and B similarly deflect during uniform swing. Therefore, a dynamically correlated, matched set of golf clubs having uniform flex feel for a golf player can be provided (a set of golf clubs having uniform flex feel can only be provided based on swing at a constant applied torque of every club in the set).

In recent high-quality shafts, deviations in weight of a large number of shafts are precisely classified by utilizing a high-precision gravimeter such as an electronic balance since their materials and temperature control during manufacture may vary. When the such classified shafts are used for a set of golf clubs, a matched set of golf clubs having substantially balanced natural frequencies can be obtained. In this case, an error in natural frequency is substantially proportional to the precision of classification by means of deviations in shaft weight. For example, in order to obtain an error of a natural frequency falling within range of about ±2 c.p.m. (cycles per minute) according to the present invention, the deviation in shaft weight is determined to fall within the range of less than 0.2%, and the thin end portions of shafts are cut by lengths at a constant ratio with respect to the club lengths. Thus, a required natural frequency can be obtained.

When the set of golf clubs is mass-produced, the moment of force of each club in the set is standardized by the above-mentioned reference, and shafts having a predetermined stiffness are used. The natural frequencies of the same type of golf club in the mass-produced sets are measured, and these clubs are classified in accordance with the measurement value. If the set of golf clubs is constituted by the golf clubs having a predetermined natural frequency and similar shaft deflection characteristics, a desired dynamically correlated, matched set of golf clubs can be obtained.

Note that when the moment of force of the set of golf clubs with similar shaft deflection characteristics is standardized using the reference according to the present invention, the present invention involves a set of shafts whose natural frequency substantially coincides with that of this set.

DETAILED DESCRIPTION OF THE PREFERRED EMBODIMENTS

Figure 1:
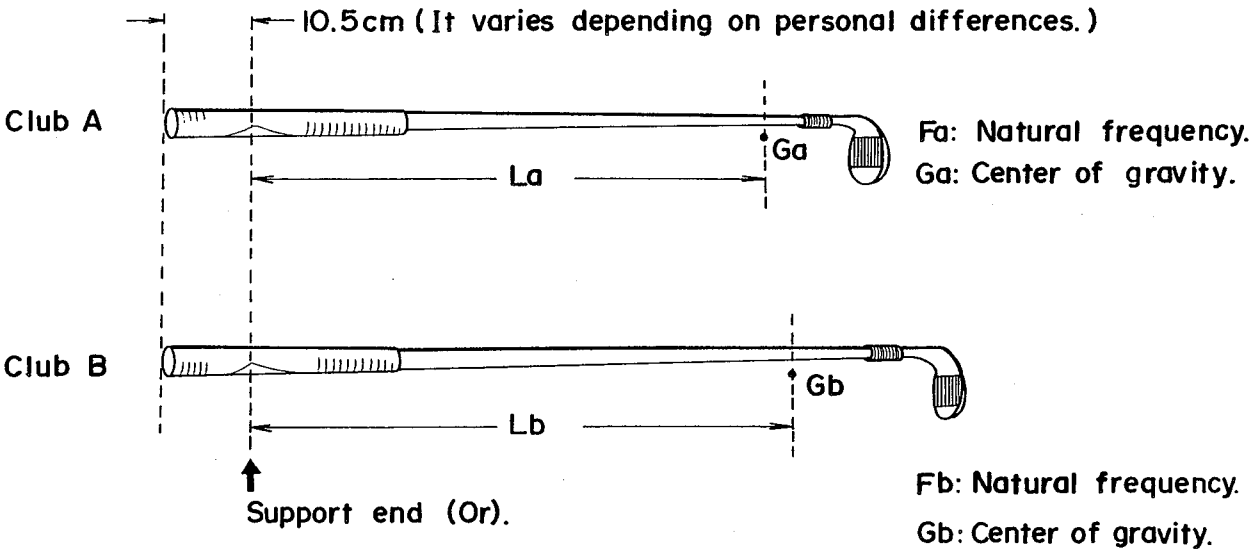

In a set of golf clubs shown in Table 1, based on the reference of the present invention, a moment of force of a set of woods is standardized to be 25,700 (±100) g cm and that of a set of irons is standardized to be 26,800 (±100) g cm, and steel shafts are adopted, whereby a dynamically correlated, matched set of golf clubs is provided.

Note that in Table 1, W indicates woods, and I indicates irons.

Table 1, the measurement reference was located at a position spaced from the grip end by 10.5 cm, and a gravimeter available from Mettler, Corp, Switzerland (electronic balance, Mettler PE-1600) and a natural frequency measurement device available from Fujikura Rubber Kogyo, K.K. Japan were used.

TABLE 1

| Type of Club W: Woods I: Irons | Club Length (Inches) | Natural Frequency (c.p.m.) |
|---|---|---|
| W: #1 | 43.0 | 263 |
| W: #3 | 42.0 | 265 |
| W: #4 | 41.5 | 266 |
| I: #3 | 38.5 | 318 |
| I: #4 | 38.0 | 320 |
| I: #5 | 37.5 | 322 |
| I: #6 | 37.0 | 325 |
| I: #7 | 36.5 | 328 |
| I: #8 | 36.0 | 332 |
| I: #9 | 35.5 | 336 |
| I: PW | 35.0 | 341 |

According to the present invention, the central portion to both hands of a golf player who holds a golf club grip is determined as a novel reference for standardizing the moment of force of a set of golf clubs and matching the stiffness characteristic of a set of shafts. Therefore, a set of golf clubs can be dynamically correlated in consideration of personal differences such as sex, sizes of hands and the like.

According to the present invention, if a golf player can select only one best golf club, the moments of force of other golf clubs in the set can be standarized by the method of the present invention, and shafts of these clubs can be replaced with ones having stiffness characteristics that can substantially satisfy the relation Fa·La=Fb·Lb, thereby dynamically correlating and matching the set of golf clubs. In this manner, deflection, of shafts during swing can provide substantially uniform flex feel of the set.

What is claimed is:

1. A dynamically correlated, matched set of golf clubs which comprises a plurality of golf clubs each of which has a shaft having one ends with a grip and the other end with a head, each said grip having a substantially uniform weight, said plurality of shafts each having a different shaft length and the shaft deflection characteristics of each shaft being substantially similar such that the deflection of eahc shaft at a given distance from a reference point on said shaft substantially uniform when a given torque is applied to each club about said reference point, moments of force at the head end sides of said golf clubs are standardized with reference to a portion of said grip central to both hands of a golf player who holds the golf club grip such that the base of one hand is at the top of the grip during swing as a rotating axis, and when natural frequencies at the head end side of said golf clubs in said set are measured with reference to said central portion as a support end so that natural frequencies of arbitrary clubs A and B arbitrarily selected from said set are given as Fa and Fb and lengths from the support end to the centers of gravity extending from the support ends to head ends of said selected clubs are given as La and Lb, each shaft has a stiffness characteristic satisfying a substantial relation $Fa \cdot La = Fb \cdot Lb$.

2. A dynamically correlated, matched set of golf clubs according to claim 1, wherein said set of golf clubs consists of a set of at least seven iron golf clubs (each of which contains a non-ferrous metal, a synthetic resin, or a composite material as a major constituent material and includes a so-called putter) as a series of golf clubs having different lengths, or includes a set of at least seven iron golf clubs of a series of golf clubs having different lengths.

3. A dynamically correlated, matched set of golf clubs according to claim 1, wherein said set of golf clubs consists of a set of at least three wood golf clubs (including a so-called wood club containing a metal, a synthetic resin, or a composite material as a major constituent material) as a series of golf clubs having different lengths, or includes a set of at least three wood golf clubs of a series of golf clubs having different lengths.

4. A method of producing a dynamically correlated, matched set of golf clubs each of which has a shaft having one end with a grip and the other end with a head, said shafts having different lengths and said shafts having shaft flexure characteristics which are substantially similar such that the deflection of each shaft at a given distance from a reference point on said shaft is substantially uniform when a given torque is applied to each club about said reference point comprising the steps of predetermining a portion on a grip central to both hands of a golf player who hold a golf club grip such that the base of one hand is at the top of the grip during swing as a common reference, standardizing the moments of force of said set of golf clubs based on the determined reference as a rotating axis, and selecting a stiffness characteristic for each of said shafts wherein natural frequencies of clubs A and B arbitrarily selected from said set are given Fa and Fb measured with the common reference as a support end and distances extending to the head ends of said clubs from the support ends to the centers of gravity are given La and Lb such that each shaft has a stiffness characteristic satisfying a substantial relationship $Fa \cdot La = Fb \cdot Lb$, thereby producing a dynamically correlated, matched set of golf clubs.

* * * * *

UNITED STATES PATENT OFFICE
CERTIFICATE OF CORRECTION

PATENT NO. : 4,900,025

DATED : February 13, 1990

INVENTOR(S) : Noriyuki Suganuma

It is certified that error appears in the above-identified patent and that said Letters Patent is hereby corrected as shown below:

On the title page:

[76] "Nigata-Minami" should read -- Nagata-Minami--

[56] OTHER PUBLICATIONS
"pp 560-64" should read --pps 60-64--.

Column 3, line 22
"Fb · La=Fb · Lb" should read --Fa · La = Fb · Lb--

"satifsy" should read --satisfy--

Column 4, line 62
'eahc" should read -- each--

Signed and Sealed this

Twentieth Day of August, 1991

*Attest:*

HARRY F. MANBECK, JR.

*Attesting Officer*

*Commissioner of Patents and Trademarks*